United States Patent [19]

Schrödl

[11] Patent Number: 4,506,837

[45] Date of Patent: Mar. 26, 1985

[54] IMPACT CRUSHER

[75] Inventor: Hermann Schrödl, Gallspach, Austria

[73] Assignee: Fried.Krupp Gesellschaft mit beschraenkter Haftung, Essen, Fed. Rep. of Germany

[21] Appl. No.: 368,353

[22] Filed: Apr. 14, 1982

[30] Foreign Application Priority Data

Apr. 17, 1981 [AT] Austria ..... 1780/81

[51] Int. Cl.[3] ..... B02C 13/31

[52] U.S. Cl. ..... 241/97; 241/189 R

[58] Field of Search ..... 241/152 A, 275, 152 R, 241/69, 154, 189 R, 88.4, 89.1, 97

[56] References Cited

U.S. PATENT DOCUMENTS

| | | | |
|---|---|---|---|
| 1,621,938 | 3/1927 | Liggett | 241/97 X |
| 3,146,959 | 9/1964 | Putnam, Jr. | 241/189 R X |
| 3,170,643 | 2/1965 | Hanse et al. | 241/189 R |
| 3,447,758 | 6/1969 | Oznobichine | 241/189 R X |
| 3,659,794 | 5/1972 | Hemesath | 241/189 R |

*Primary Examiner*—Mark Rosenbaum

*Attorney, Agent, or Firm*—Spencer & Frank

[57] ABSTRACT

An impact crusher, especially for crushing stone, includes a housing (1) which comprises a delivery chute (5) for supplying the material to be crushed to a rotor (3) which has beater blades (4), rotates about a horizontal axis and with which rebound walls (7) are associated, which rebound walls (7) approach the rotor (3) in the region of the upper quadrant of the descending side of the rotor (3) and form, with the latter, a delivery opening (8) for the crushed material. One or more slipways (11, 12) project in the region of the delivery opening (8) from the rebound wall (7) towards the rotor (3) and form, with their upper edge, a guideway which extends from the delivery-opening (8) at a slight angle towards the horizontal and is guided upwards in a direction over the rotor (3).

8 Claims, 6 Drawing Figures

IMPACT CRUSHER

BACKGROUND OF THE INVENTION

The invention relates to an impact crusher, especially for crushing stone, having a housing which comprises a delivery chute for supplying the material to be crushed to a rotor which is mounted in the housing, the rotor having beater blades, and rotating about a horizontal axis, the housing also comprising rebound walls, which approach the rotor in the region of the upper quadrant of the descending side of the rotor and form, with the latter, a delivery opening for the crushed material.

An impact crusher of this type is known (see Austrian Patent Specification Nos. 319019 and 332712), in which the rebound walls are formed by a rebound mechanism which is suspended about an axis, parallel to the rotor axis, so as to be pivoted away from the rotor. The rebound mechanism ends in the region of a delivery opening in a wall part which extends approximately tangentially to the circular path of the rotor. The pivotable arrangement of the rebound mechanism enables the width of the opening to be adjusted as required.

A similar embodiment is described in Austrian Patent Specification No. 288827 wherein the rebound plates forming the rebound walls are arranged on a plurality of rocker arms which are pivotable about an axis parallel to the rotor axis. The rocker arms, which are arranged parallel to one another and side by side, are supported on the crusher housing by springs, so that the rebound plates can also move to one side in order to adjust the width of the opening if foreign bodies or stones which are too large enter the delivery opening.

Austrian Patent Specification No. 289522 also describes an impact pulverizer in which the rebound walls are formed by rebound plates arranged next to and spaced from one another and extending in the axial direction of the rotor. The surfaces of these rebound plates, which extend transversely to the direction in which the stones are delivered, are inclined at different angles towards the vertical plane, the delivery opening being defined by a grinding plate, the surface of which extends approximately tangentially to the circular path of the rotor.

In the impact crushers of the described type the stones are crushed on one hand by the direct action of the beater blades of the rotor and on the other by the impact of the stones on the rebound walls. The extent to which the material is crushed is determined in particular by the width of the delivery opening. The large stones which are delivered may not always break immediately when coming into contact with the beater blades, as a result of which fairly large stones may settle at the entrance of the delivery opening and become wedged there between a beater blade and the rebound wall adjacent the delivery opening. As a result, the machine may be seriously damaged or ruined. Although considerable damage is prevented if the rebound walls are suspended so as to be pivotable, the stones pass through the machine without being crushed. However, in the case of fixed rebound walls, and if the pivotable rebound walls do not move to one side quickly enough, the rotor, the rotor shaft and the drive devices are usually damaged. In comparison to their size, only relatively small and easily breakable stones can therefore be treated by the known impact crushers. These machines also require a considerable amount of power for their drive.

The object of the present invention is to improve the hitherto known impact crushers so that even fairly large stones cannot become jammed in the region of the delivery opening.

SUMMARY OF THE INVENTION

Thus according to the invention it is arranged that at least one slipway projects in the region of the delivery opening from the rebound wall towards the rotor and forms, with its upper edge, a guideway which extends from the delivery opening at a slight angle towards the horizontal and is guided upwardly in a direction over the rotor. Even fairly large stones cannot become jammed between the beater blades of the rotor and the rebound wall in this construction. The larger stones which reach the region of the delivery opening can move away along the guideway when the beaters strike them. They are thrown upwards away from the delivery opening, strike the rebound walls and fall onto the rotor again. This procedure is repeated until the stones are crushed to an extent such that they can pass through the delivery opening.

The angle of inclination at which the guideway rises relative to the horizontal should not be too small, as otherwise smallish stones may settle on the slipways and prevent larger stones sliding away from the delivery opening. However, the angle of inclination should also not be too great, as otherwise the stones become wedged. In a preferred embodiment of the invention the guideway formed by the slipways intersects the circular path of the rotor and forms an obtuse angle with a tangent plane passing through the line of intersection in the region adjacent the delivery opening. The slope of the guideway resulting from these dimensions is such that even larger stones cannot become wedged.

A plurality of slipways of different heights and lengths is preferably provided and the stones which are raised normally only strike a slipway at one point, as a result of which the explosive effect of the impact is increased accordingly. Practically the same effect is produced by the other embodiment of the invention, according to which, even in the regions remote from the delivery opening, the rebound walls have slipways which project over their inner surface and extend transversely of or in the axial direction of the rotor. The explosive effect on the stones can also be improved according to the invention by forming the slipways as cutting edges. Furthermore, at least some of the slipways can end in freely projecting corners at their leading ends facing the rotor.

In a further embodiment of the invention the slipways in the region of the delivery opening may be arranged so that they can be moved towards the rotor. Apart from the fact that this arrangement enables the width of the delivery opening to be adjusted, it also allows the slipways to be adjusted, even when worn, and, if necessary, simply exchanged.

A further improvement to the impact crusher according to the invention can be achieved if the slipways in the region of the delivery opening are arranged so as to be pivotable about an axis parallel to the rotor axis and are held in the operating position by a restoring force, e.g., a spring or a hydraulic device.

The impact crusher according to the invention enables stones of a relatively large size, in comparison with the size of the machine, to be crushed. A primary crusher, which would otherwise be necessary, need not therefore be used. As stones are prevented from becoming jammed in the region of the delivery opening and are repeatedly guided upwards from this region along the guideway, they are circulated numerous times in the crushing space; as a result of this they are subjected to many impacts until they are crushed to the desired size. The machine according to the invention is also characterised by an economical power consumption, as smaller and medium-sized stones also do not have to be fragmented by a single impact, but are raised again by the rotor until they finally splinter.

DESCRIPTION OF THE DRAWING

Further details of the invention are disclosed in the following description of an embodiment illustrated in the drawings, in which FIG. 1 schematically shows a longitudinal section, extending transversely to the rotor, through an impact crusher according to the invention.

DETAILED DESCRIPTION OF THE PREFERRED EMBODIMENT

Figure 5:
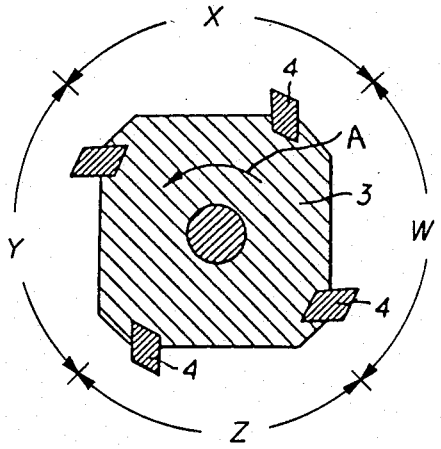
FIG. 5 is a sectional view of the rotor element and indicates the four quadrants defined thereby in its direction of rotation.

The illustrated impact crusher comprises a crusher housing 1, which is made of steel with reinforcement ribs 2. A rotor 3 is mounted in the housing 1 so as to rotate in the direction of the arrow about a horizontal axis. The rotor 3 has beater blades located about its outer periphery 4. The rotor 3 is rotated by a suitable means (not shown) in the direction indicated by arrow A (see FIG. 5), and can be considered to define in the direction of its rotation an ascending quadrant W, an upper, generally horizontal quadrant X, a descending quadrant Y and a lower, generally horizontal quadrant Z. A delivery chute 5 is provided to supply the material to be crushed to the rotor 3 i.e., toward the area where the ascending quadrant W intersects the upper, generally horizontal quadrant X. The crushing space 6, which is above the rotor 3, is enclosed by rebound walls 7, which approach the rotor 3 at the side opposite the delivery chute 5 as far as a delivery opening 8 for the crushed material. A grinding space 9, which is defined by a pivotable grinding plate 10, is disposed below the delivery opening 8.

Figure 2:
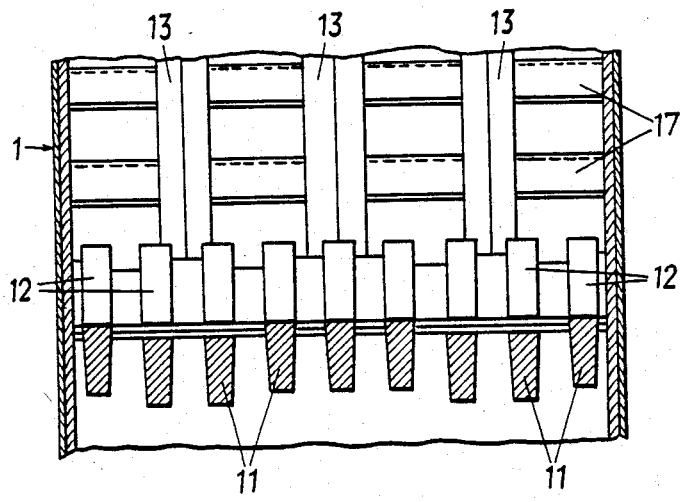
FIG. 2 is a section through a detail along II—II of FIG. 1, FIGS. 3 and 4 are two further sections through details along the lines III—III and IV—IV of FIG. 1.

The rebound walls 7 have slipways which project over their inner surface and are arranged in the manner of rails transversely to the axis of the rotor 3. Several lower slipways 11 are arranged parallel and next to one another to extend near the rotor at the area where the upper, generally horizontal quadrant X intersects the descending quadrant Y to define the delivery opening 8, as shown in FIG. 2. Further slipways 12 which, according to FIG. 2, are equal in number to the lower slipways 11, are arranged adjacent the latter and extend obliquely upwardly. Three slipways 13, which are clearly shown in FIG. 3 and project over the rebound wall 7, are arranged at the other side wall, which extends upwardly, of the housing 1, and a further slipway 14 which, according to FIG. 4, extends approximately in the centre of the housing, is suspended at the rebound wall 7 which closes the crushing space 6 at the top. The lower slipways 11 are inserted in guides so as to be displaceable in the direction of their longitudinal axis, which guides are secured to the housing 1 so as to be pivotable about pins 15. Springs 16 hold the lower slipways 11 in the correct position. The slipways 12, 13 and 14 are mounted on cross-beams 17 of the rebound walls 7. The grinding plate 10 is also suspended so as to be pivotable about a pin 18 against a spring 19.

Figure 6:
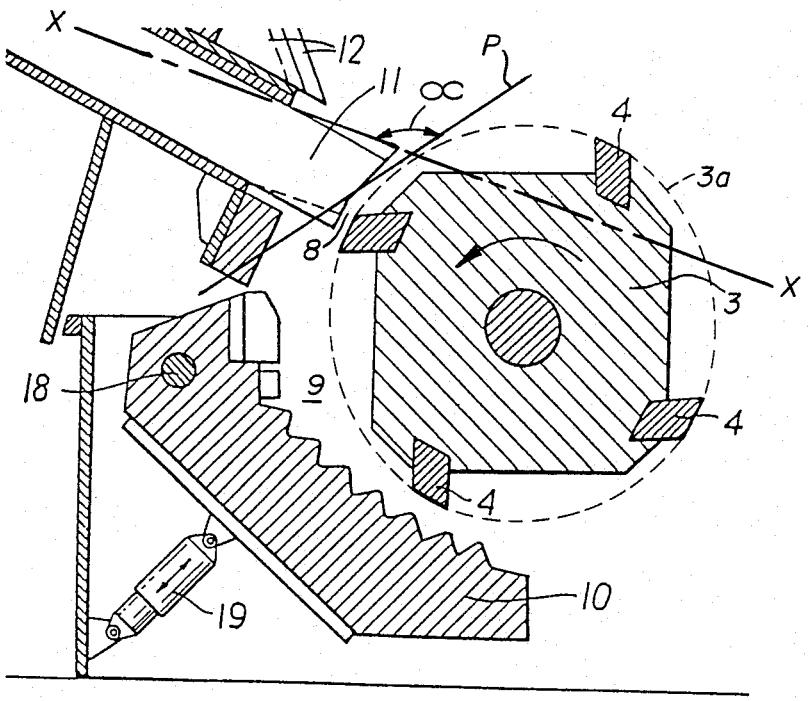
FIG. 6 is an enlarged detail of the impact crusher shown in FIG. 1.

The stones which are supplied by the delivery chute 5 are immediately caught by the beater blades 4 of the rotor 3 upon leaving the delivery chute 5 and initially thrown upwardly against the rebound walls 7 where the larger stones strike the slipways 12, 13 and 14, whereas the smaller stones strike the rebound walls 7 between the slipways and the cross-beams 17. These smaller stones do not prevent the larger stones striking the slipways 12, 13 and 14. The stones falling and sliding down from the rebound walls 7 then reach the region of the delivery opening 8. The smaller stones can pass through this opening into the grinding space 9, where they are guided over the grinding plate 10 and further reduced in size. However the larger stones remain in the region of the delivery opening 8. As the lower slipways 11 are inclined at a slight angle towards the horizontal in the region of the delivery opening 8, i.e., such that an imaginary straight line X—X extending along each upper guideway surface will intersect an imaginary plane P which is tangential to an imaginary circle 3*a* defined by the rotating rotor 3 at an obtuse angle $\alpha$ (see FIG. 6), it is also impossible for larger stones to become wedged between the beater blades 4 and the lower slipways 11. On the contrary, the lower slipways 11 and the slipways 12, 13 and 14, which are adjacent one another, form a guideway which leads upwardly and by way of which the stones are thrown upwardly away from the delivery opening 8 into the crushing space 6. Larger stones are therefore spun around by the beater blades 4 in the crushing space 6 until they are crushed to a sufficiently small size to pass through the delivery opening 8 into the grinding space 9.

Figure 1:
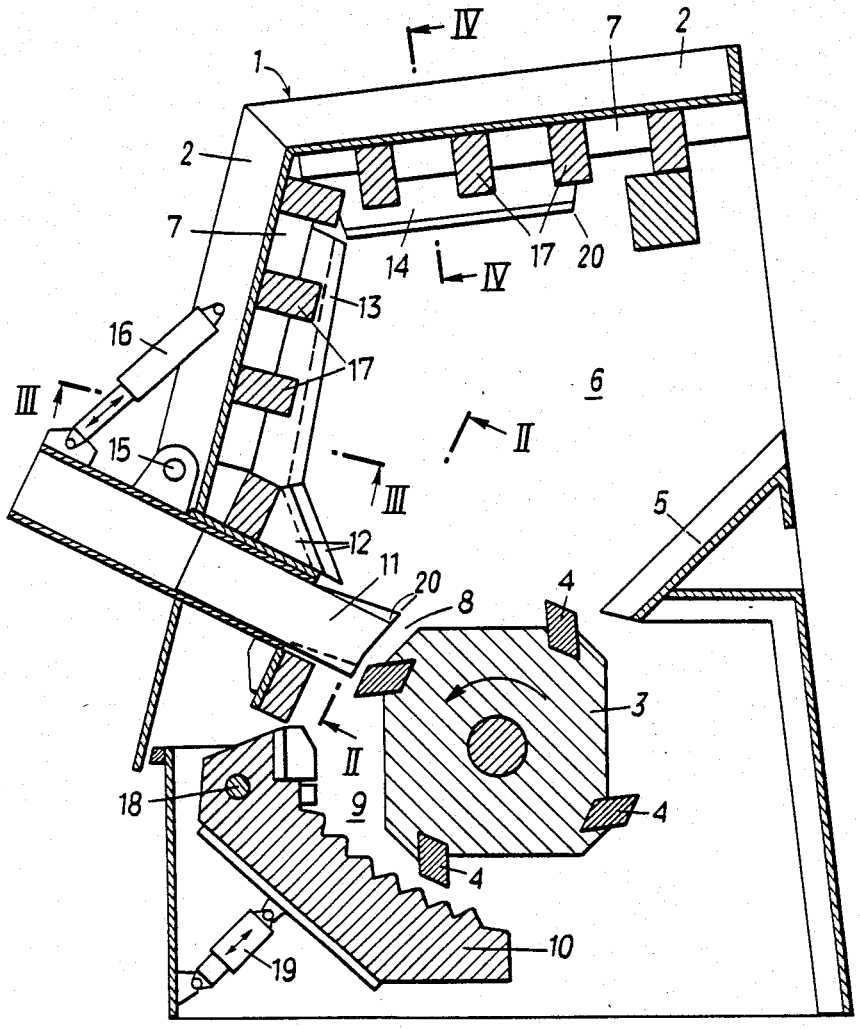
Figure 3:
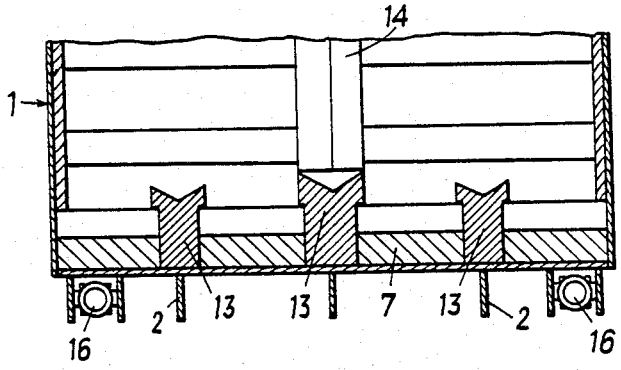
Figure 4:
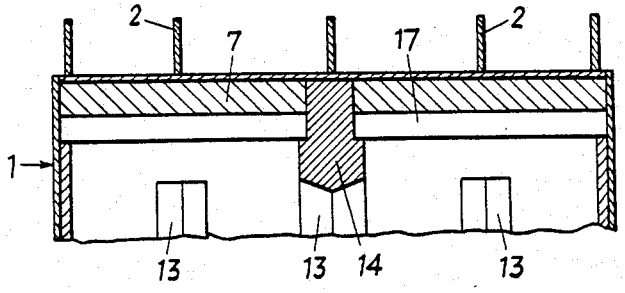

As can be seen from FIGS. 2, 3 and 4, the slipways which are provided over the rebound walls 7 differ in number, construction and height. According to FIG. 2, the lower slipways 11 disposed parallel and next to one another are arranged so as to differ in height, as are the slipways 13 illustrated in FIG. 3. These are also formed in the manner of cutting edges. Whereas the cutting edges in the embodiment according to FIG. 3 are in each case arranged at the side edges of the slipways 13, the slipways 14 according to FIG. 4 have a central cutting edge. Finally, some of the slipways, e.g., the lower slipways 11 and the slipways 14, end at their front ends facing the rotor 3 in freely projecting corners, which are indicated by 20 in FIG. 1. All these measures serve to improve the crushing properties of the impact crusher.

I claim:

1. An impact crusher which is useful for crushing materials such as stone, said material impact crusher comprising, a housing, a rotor mounted within said housing so as to rotate about a horizontal axis, said rotor including beater blades non-pivotally connected thereto about its outer periphery, said rotor defining in its direction of rotation an ascending quadrant, an upper, generally horizontal quadrant, a descending quadrant, and a lower, generally horizontal quadrant, a delivery chute which extends into said housing so as to deliver material to be crushed toward said rotor at the area where said ascending quadrant intersects said upper, generally horizontal quadrant, a plurality of rebound walls located within said housing, said rebound walls including a lower section which extends near said rotor at the area where said upper, generaly horizontal quadrant intersects said descending quadrant, thus forming a delivery opening therebetween, and a plurality of separate elongated lower slipways which are associated with said lower section of said rebound walls and which extends into said delivery opening, each lower slipway defining a flat upper guideway surface which extends upwardly away from said delivery opening at an angle above horizontal such that an imaginary straight line extending along each flat upper guideway surface toward said delivery opening will intersect an imaginary plane which, at said delivery opening, is tangential to an imaginary circle defined by the rotating rotor at an obtuse angle, thus enabling pieces of material which are too large to pass through said delivery opening to move away from said delivery opening by sliding along the upper guideway surfaces of said slipways and thereafter be returned along said upper guideway surfaces to said delivery opening for contact with said beater blades, thus avoiding damage to said non-pivoting beater blades, said rotor and said lower slipways.

2. An impact crusher as defined in claim 1 wherein each of the rebound walls includes a slipway associated therewith, the slipways associated with the separate rebound walls having different height and width dimensions.

3. An impact crusher as defined in claim 2 wherein each slipway is shaped to define a cutting edge against which material to be crushed can impact.

4. An impact crusher as defined in claim 2 wherein at least some of said slipways define freely projecting corners facing said rotor.

5. An impact crusher as defined in claim 1 wherein means are connected to each said lower slipway to move each said lower slipway toward or away from said rotor.

6. An impact crusher as defined in claim 1 wherein means are connected to each said lower slipway to pivot each said lower slipway about a mounting axis extending parallel to the axis of said rotor.

7. An impact crusher as defined in claim 6 wherein said means includes a spring to hole each said lower slipway in the desired position about said mounting axis.

8. An impact crusher as defined in claim 7 wherein said means includes a hydraulic device to hold each said lower slipway in a desired position about said mounting axis.

* * * * *